US011441784B2

(12) United States Patent
Homburg et al.

(10) Patent No.: US 11,441,784 B2
(45) Date of Patent: Sep. 13, 2022

(54) GUIDING DEVICE FOR A CARRIER FOR FOOD TO BE COOKED

(71) Applicant: PAUL HETTICH GMBH & CO. KG, Kirchlengern (DE)

(72) Inventors: Kathrin Homburg, Bunde (DE); Johann-Sebastian Lessmann, Kirchlengern (DE)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 0 days.

(21) Appl. No.: 17/257,833

(22) PCT Filed: Jul. 2, 2019

(86) PCT No.: PCT/EP2019/067722
§ 371 (c)(1),
(2) Date: Jan. 4, 2021

(87) PCT Pub. No.: WO2020/007854
PCT Pub. Date: Jan. 9, 2020

(65) Prior Publication Data

US 2021/0293416 A1 Sep. 23, 2021

(30) Foreign Application Priority Data

Jul. 4, 2018 (DE) ..... 102018116219.7

(51) Int. Cl.
*F24C 15/16* (2006.01)

(52) U.S. Cl.
CPC ..... *F24C 15/168* (2013.01)

(58) Field of Classification Search
CPC ..... F24C 15/16; F24C 15/168; A47B 88/43; A47B 2210/17; A47B 46/00; A47F 5/01; Y10S 211/00
(Continued)

(56) References Cited

U.S. PATENT DOCUMENTS 6,643,900 B2 * 11/2003 Jahrling ..... A47B 55/02 24/336
2014/0334751 A1 * 11/2014 Meyer ..... A47B 88/43 384/22
(Continued)

FOREIGN PATENT DOCUMENTS

DE 19947153 A1 * 4/2001 ..... F24C 15/16
DE 102005054604 5/2007
(Continued)

OTHER PUBLICATIONS

Machine Translation of Roesch (Year: 2001).*
(Continued)

*Primary Examiner* — Avinash A Savani
(74) *Attorney, Agent, or Firm* — Barnes & Thornburg LLP

(57) ABSTRACT

A guide device for a cooking rack comprises a side grid and a pull-out guide with rails movable relative to one another, wherein a stationary rail can be fixed to a strut of the side grid via at least two holders, wherein at least the strut to which the at least two holders are fixed has a cross-section deviating from the circular shape, and at least one holder has a contact surface which lies flat against the strut. In this way, the pull-out guide can be firmly fixed to the strut.

12 Claims, 20 Drawing Sheets

(58) Field of Classification Search
USPC ..... 126/339
See application file for complete search history.

(56) References Cited

U.S. PATENT DOCUMENTS

| | | | | |
|---|---|---|---|---|
| 2017/0303685 | A1* | 10/2017 | Rehage | A47L 15/507 |
| 2018/0084910 | A1 | 3/2018 | Homburg et al. | |

FOREIGN PATENT DOCUMENTS

| | | |
|---|---|---|
| DE | 102008031943 | 8/2009 |
| DE | 102010017115 | 12/2011 |
| DE | 102011056304 | 6/2013 |
| DE | 102016118267 | 3/2018 |
| DE | 102017118544 | 2/2019 |
| EP | 2487422 | 8/2012 |
| EP | 2843316 | 3/2015 |

OTHER PUBLICATIONS

English Translation of ISA Written Opinion (Year: 2022).*
Search Report issued in German Appl. No. 102018116219.7 (dated 2019).
Search Report issued in Int'l Appl. No. PCT/EP2019/067722 (dated 2019).

* cited by examiner 30
6
20
10

8
7
30
6
20
10

30
6
8
7
20
10

10
20
8
6
7
30

20

GUIDING DEVICE FOR A CARRIER FOR FOOD TO BE COOKED

CROSS-REFERENCE TO RELATED APPLICATIONS

This application is a U.S. nationalization under 35 U.S.C. § 371 of International Application No. PCT/EP2019/067722, filed Jul. 2, 2019, which claims priority to German Patent Application No. 102018116219.7, filed Jul. 4, 2018. The disclosures set forth in the referenced applications are incorporated herein by reference in their entireties

BACKGROUND AND SUMMARY OF THE DISCLOSURE

The present disclosure is directed to a guide device for a cooking rack, comprising a side grid and a pull-out guide with rails movable relative to one another, whereby a stationary rail can be fixed to a strut of the side grid via at least two holders.

DE 10 2016 118 267 A1 discloses a household appliance in which a pull-out guide with a guide rail can be fixed to a side grid via holders. The holders surround a cylindrical rod of a side grid and have wall sections that widen at an acute angle which can be placed against the rod. Such fastening systems are known in many ways and have the disadvantage that the holders can be rotated around the axis of the cylindrical rod. This can lead to bending or torsional movements.

DE 10 2017 118 544 discloses a fastening system for fixing a drawer runner to a side grid, in which a front fastening element forms a substantially V-shaped receptacle that embraces the front angled end section of a rod from above. In this way, a play-free arrangement of the pull-out guide can be achieved, although the above-mentioned problems continue to exist due to the cylindrical design of the rod.

It is therefore the object of the present disclosure to create a guiding device in which a pull-out guide with a stable hold can be fixed to a side grid via at least two holders.

A guiding device according to the present disclosure comprises a side grid and a pull-out guide, wherein a stationary rail of the pull-out guide is fixed to a strut of the side grid via at least two holders and the strut has a cross-section deviating from the circular shape, wherein at least one holder has a contact surface which lies flat against the strut. A flat contact, which is not point or line shaped, can ensure a better hold on the strut, as a flat contact offers a better hold against turning or tilting movements. The contact surface can be flat or curved.

In either case, a rotation around a longitudinal axis is prevented, which is not possible with a cylindrical strut.

In embodiments, each holder has a contact surface that lies flat against the strut. This means that all holders can be secured against rotation relative to the strut by placing the contact surface of the holder against an outer surface of the strut.

The strut may have a rectangular cross-section. The extension in vertical direction can be larger than in horizontal direction in order to be able to absorb higher weight forces. Alternatively, the strut can be oval or square instead of rectangular.

In embodiments, at least one holder has a tab that engages under the strut. This can prevent the guide rail from tilting during an extension movement.

For a stable fixing of the stationary rail, at least one holder can embrace the strut in a U-shape. Optionally, all holders can embrace the strut L-shaped or U-shaped.

In embodiments, at least one holder has a first vertical connecting surface welded to the stationary rail and a second vertical surface that rests on the strut. In embodiments, all holders may be so configured. This prevents movement in the horizontal direction. The first vertical connecting surface and the second vertical surface can be offset in horizontal direction or arranged in a plane. Alternatively, a connecting surface of at least one holder could also be welded horizontally to the stationary rail and have only one vertical surface to rest against the strut.

For an effective production, the holders can be made of a bent steel sheet.

The strut may be configured as a full profile. Optionally, the strut can also be made of a bent steel sheet with a U-shaped or other cross-section, for example, to save material.

For a stable fixing of the guide rail, three holders may be provided, which are spaced apart from each other on the same strut to ensure a positive fit and thus fix the drawer runner.

In embodiments, the vertical extension of the strut in the installation position may be at least 40% of the vertical extension of the fixed rail.

A guide device according to the present disclosure may be used in particular for the movable support of a cooking rack, which is arranged displaceably on a baking oven muffle of an oven.

Illustrative embodiments of a guide device according to the present disclosure are explained in more detail below by means of several embodiments with reference to the attached drawings.

DETAILED DESCRIPTION OF THE DRAWINGS

Figure 1:
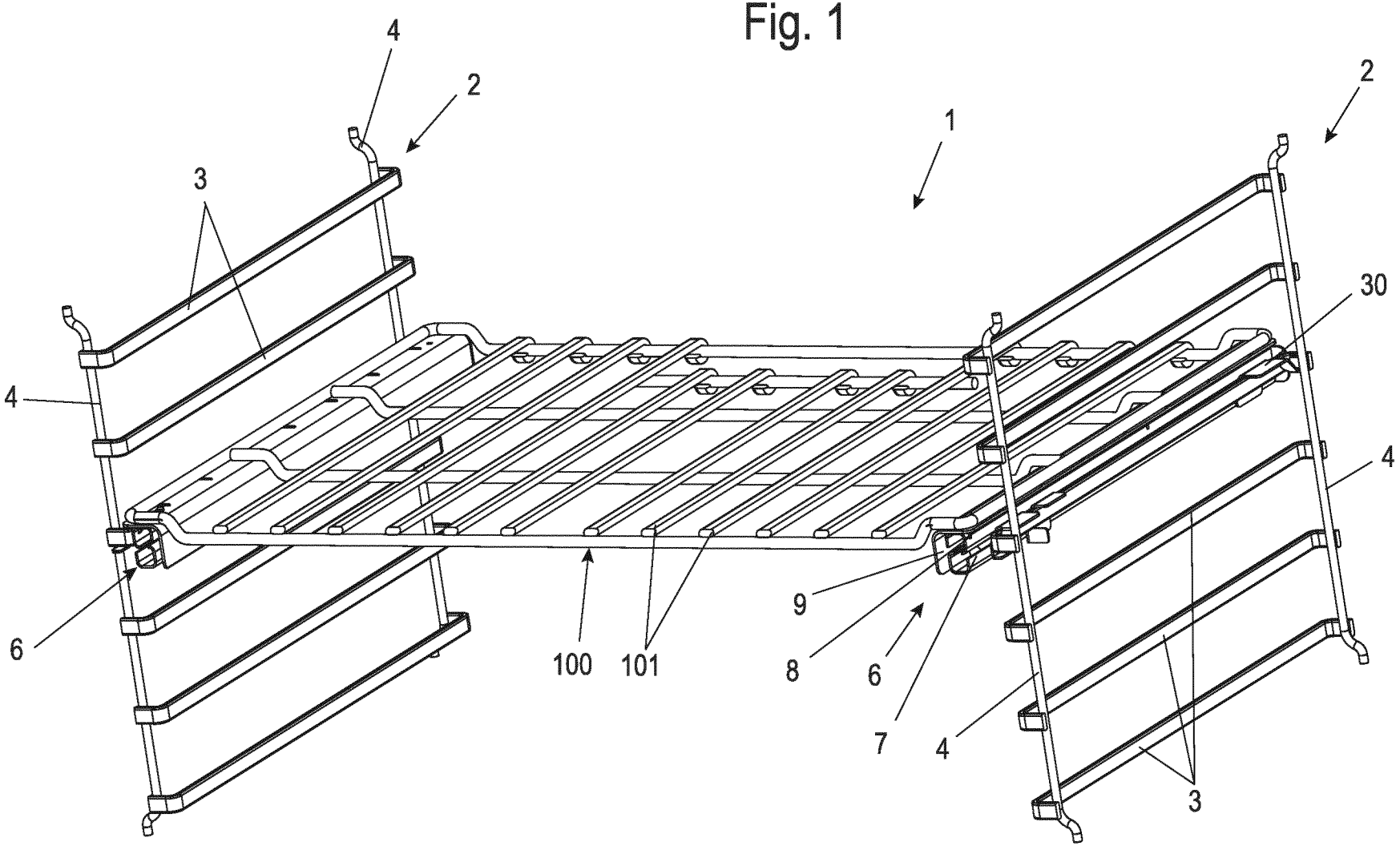
FIGS. 1 and 2 are two perspective views of a guide device for the movable support of a cooking rack.
Figure 2:
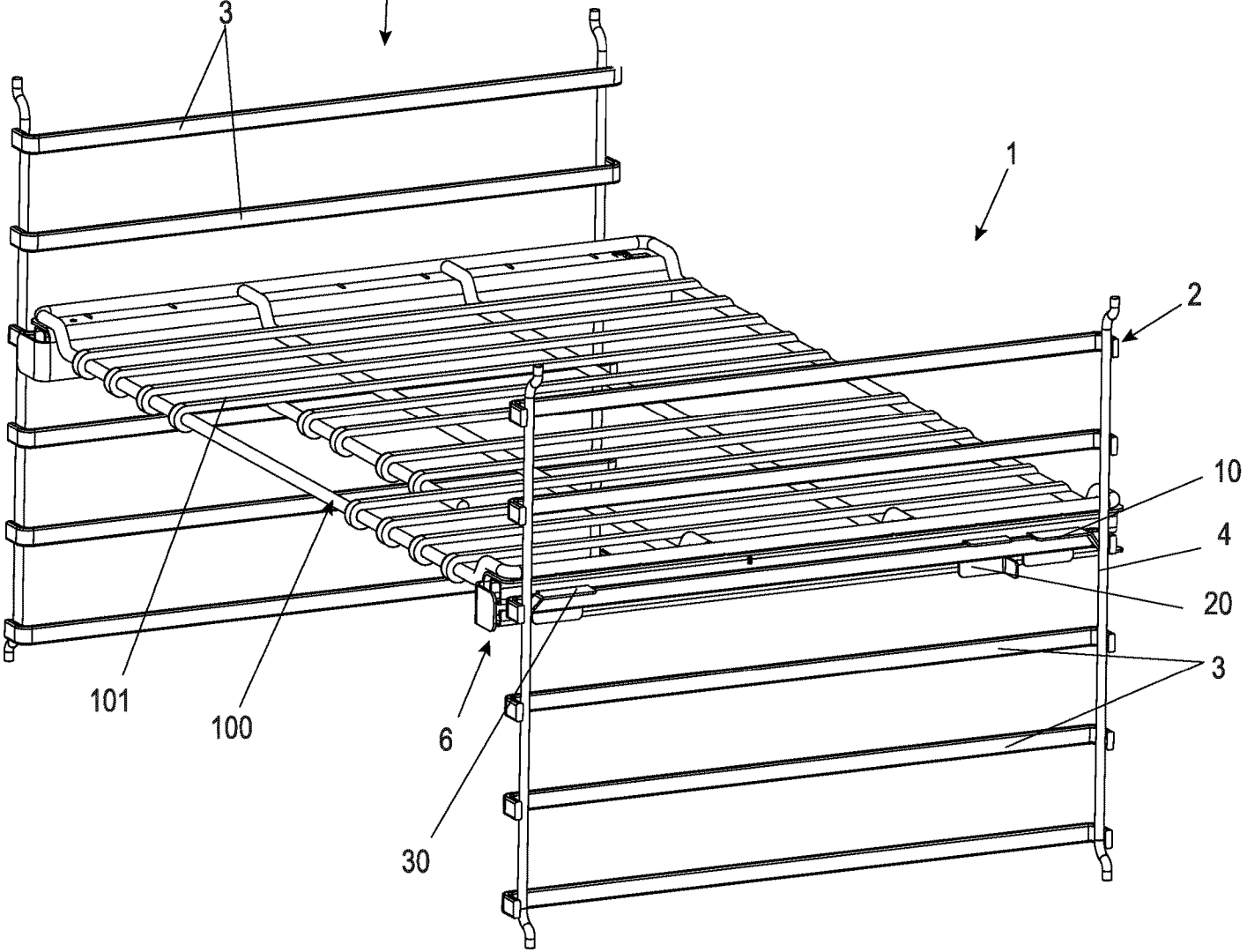
Figures 3A, 3B, 3C, 3D:
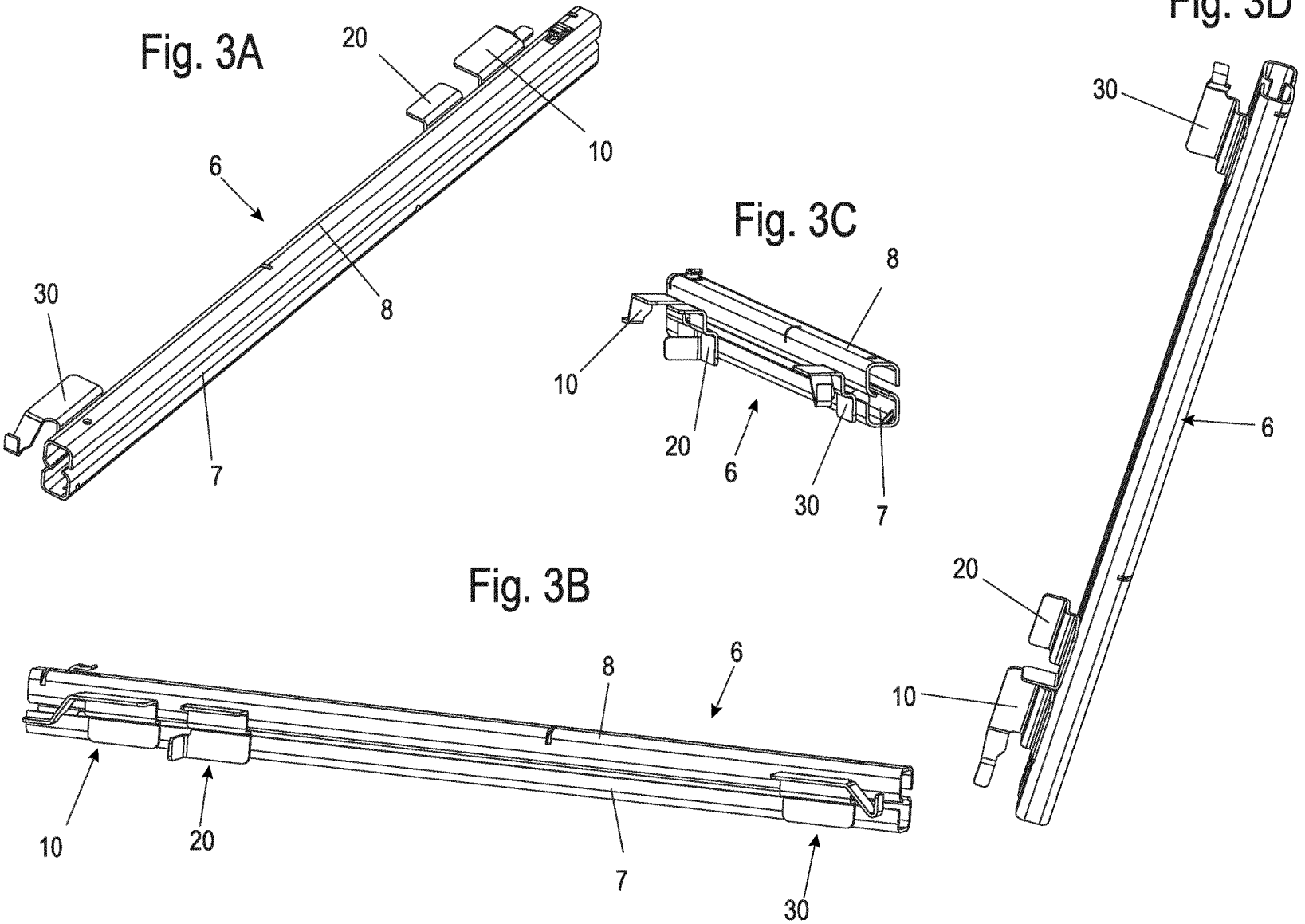
FIGS. 3A to 3D are several views of a pull-out guide of the guide device of FIG. 1.

A guide device 1 comprises two side grids 2, which can be fixed to an oven muffle of an oven. Each side grid 2 comprises horizontal struts 3 and vertical posts 4. A pull-out guide 6 is fixed to at least one strut 3 of a side grid 2, so that a cooking rack 100 can be placed on a movable rail 8 and moved. Each pull-out guide 6 comprises a stationary rail 7, which is fixed to a strut 3 via several holders. In addition to the stationary rail 7, the pull-out guide 6 can have at least one movable rail 8. Preferably, a movable middle rail for pull-out extension is arranged between the stationary rail 7 and the movable rail 8. An angular cover 9 is provided on the movable rail 8, which covers a gap between the stationary rail 7 and the movable rail 8 and thus prevents the entry of impurities.

The struts 3 on the side grid 2 are not circular in cross-section but rectangular. Also, on the cooking rack 100, there are grid bars 101, which are rectangular in cross-section.

FIGS. 3A to 3D show a pull-out guide 6 with holders 10, 20 and 30. The holders 10, 20 and 30 are fixed to the stationary rail 7 of the pull-out guide 6, in particular fixed to a vertical web of the stationary rail 7, in particular welded on. In relation to the pull-out direction of the cooking rack 100, holder 30 is located at the front, while the two holders 10 and 20 are located at the rear of pull-out guide 6.

FIGS. 4A to 4F show a section of a strut 3 with the holder 30. The strut 3 has a first section 3*a* in the longitudinal direction of the pull-out guide 6 and at opposite ends an angled end section 3*b*, which is fixed to a post 4 of the side grid 2.

The cross section of strut 3 is rectangular, whereby the extension in a vertical direction is at least twice as large as in a horizontal direction.

The holder 30 comprises an upper horizontal section 31, from which an angled vertical web 32 runs downwards. This vertical web 32 rests on an external contact surface on section 3*a* of strut 3. The flat contact of the web 32 with the outer surface of strut 3 prevents rotation about an axis in the longitudinal direction of strut 3. The vertical web 32 is followed by a step with a further vertical connecting surface 33, which is located below the vertical web 32 and to which the stationary rail 7 of the pull-out guide 6 is attached, preferably welded on.

Figure 4A:
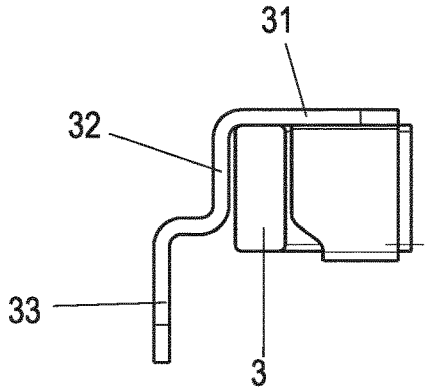
FIGS. 4A to 4F are several views of a holder for fixing the pull-out guide of FIG. 1.
Figure 4B:
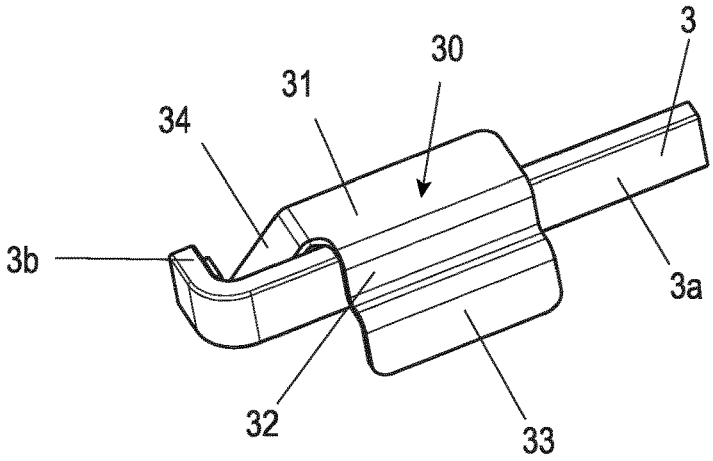
Figure 4C:
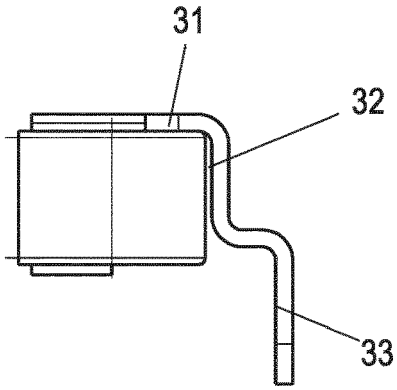
Figure 4D:
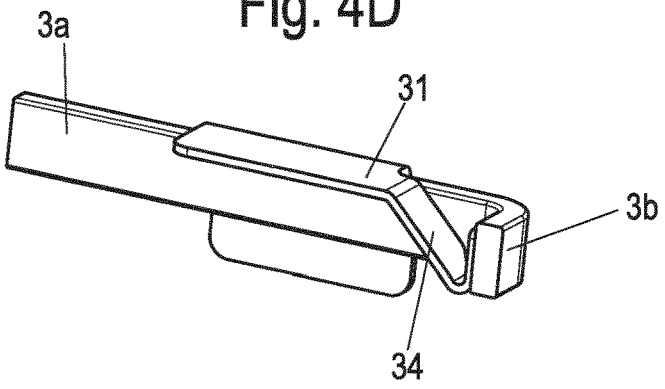
Figure 4E:
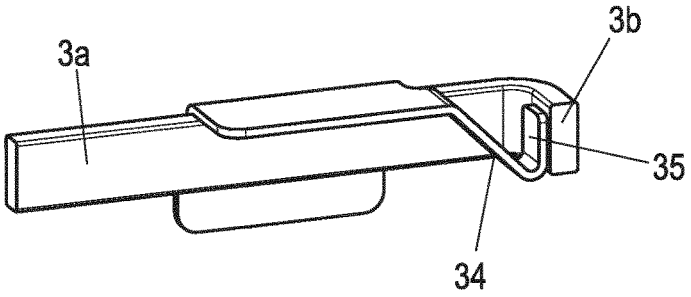
Figure 4F:
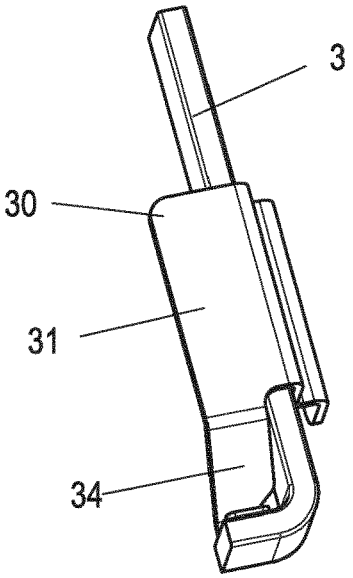

The holder 30 further comprises a downwardly inclined web 34, which starts from section 31, and on which a vertical web 35 is held, which rests against the angled end section 3*b* of the strut, as shown in particular in FIG. 4E. This vertical web 35 is also supported by a contact surface at the end section 3*b*.

Figure 5A:
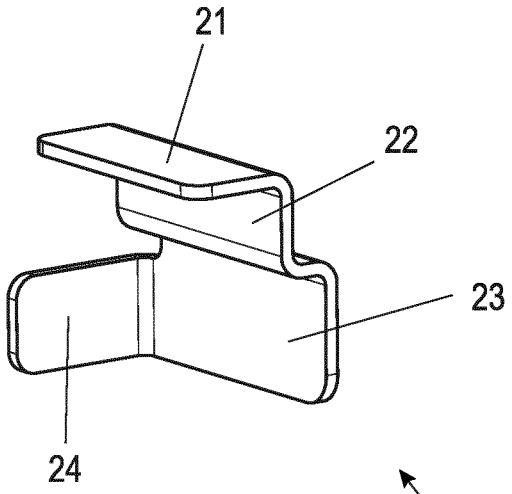
FIGS. 5A and 5B are two views of a second holder for fixing the pull-out guide.
Figure 5B:
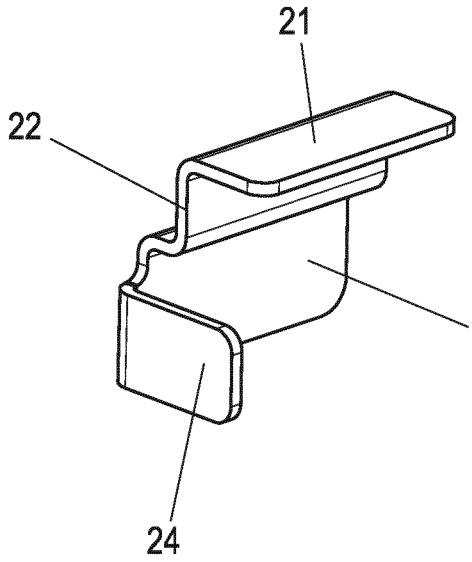

FIGS. 5A and 5B show an additional holder 20, which is provided on pull-out guide 6. The holder 20 is located centrally between the other two holders 10 and 30 and comprises an upper horizontal section 21, which is followed by a vertical web 22. The vertical web 22 can be attached to an outer surface of the strut 3. Below the web 22 there is another vertical web 23, which is arranged offset in horizontal direction to the vertical web 22 and to which the stationary rail 7 of the pull-out guide 6 is fixed. This lower web 23 is also provided with an angled retaining web 24 which extends essentially horizontally and engages underneath strut 3. In this way, the pull-out guide 6 can be secured against being lifted by the holder 20.

Figure 6A:
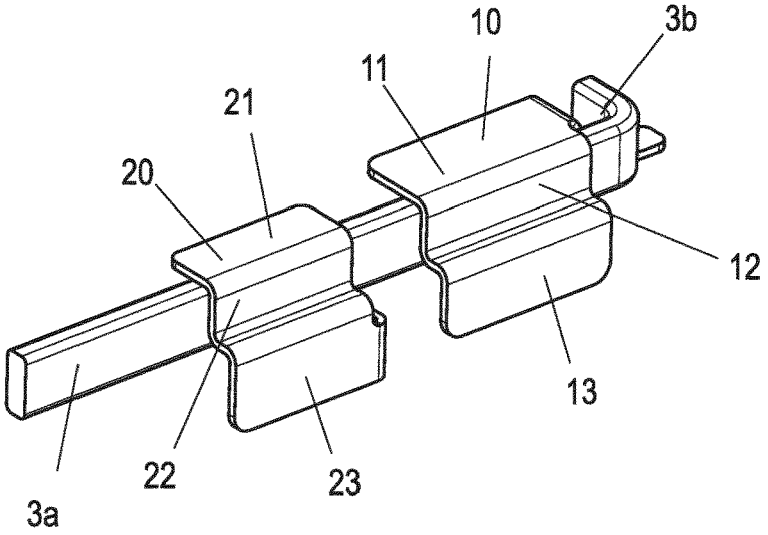
FIGS. 6A to 6C are several views of two holders on one strut of the guide device of FIG. 1.
Figure 6B:
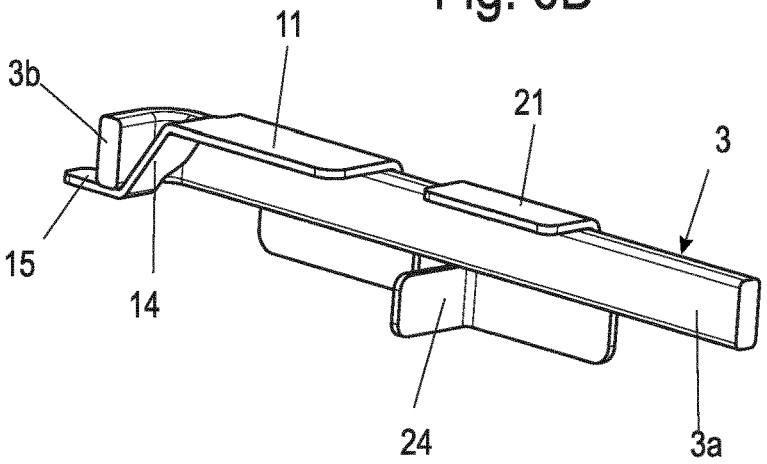
Figure 6C:
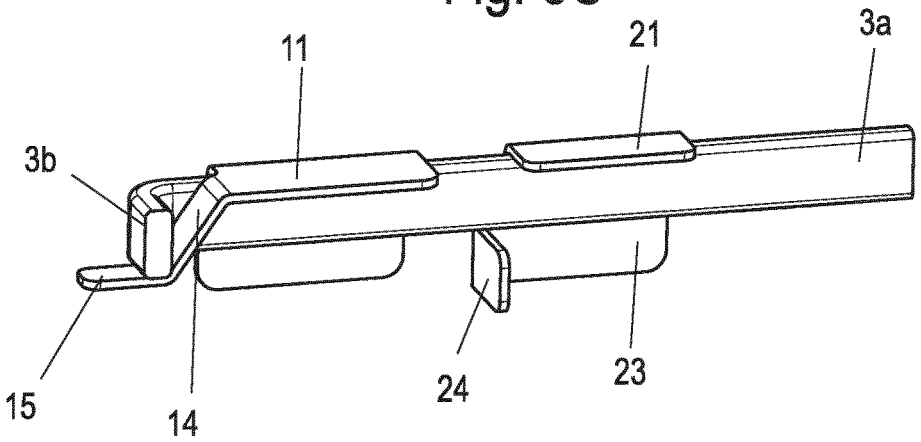

FIGS. 6A to 6C show holders 10 and 20 in a position mounted on strut 3. The vertical webs 12 and 22 each rest against a vertical surface of the strut in the area of section 3*a* parallel to the longitudinal direction of the pull-out guide 6. The retaining web 24 engages under section 3*a* as shown in FIG. 6B. The holder 10 also includes a downwardly inclined web 14 that extends from the section 11 and supports a horizontal web 15 that engages under the angled end section 3*b* of strut 3.

Figure 7:
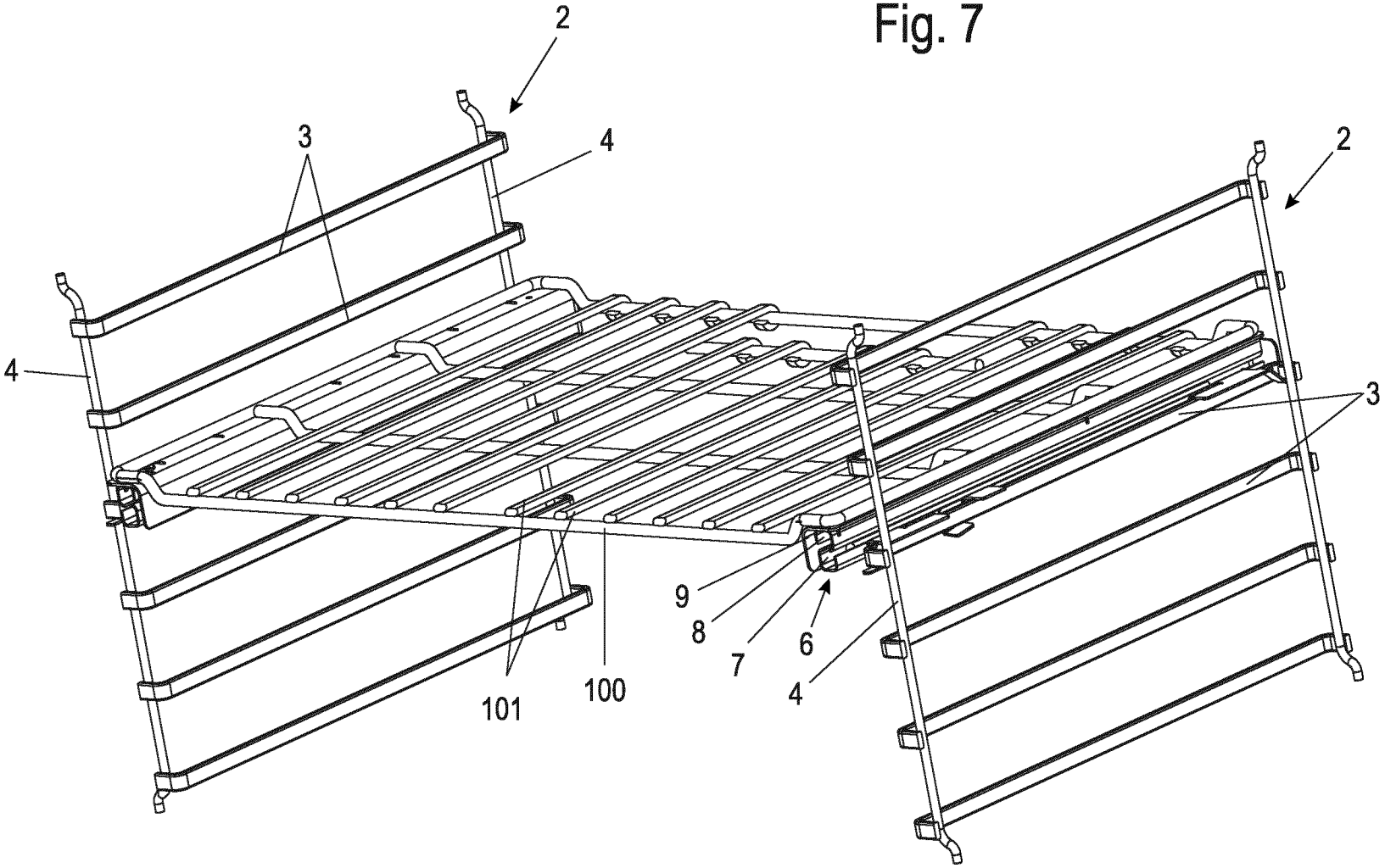
FIG. 7 is a perspective view of a modified guide device.
Figure 8C:
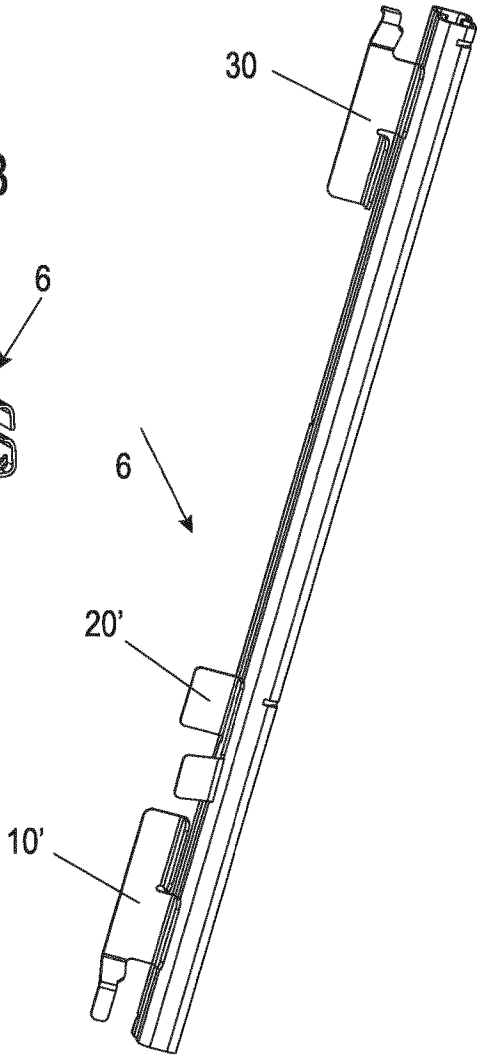
FIGS. 8A to 8D are several views of a drawer slide with holder of the guide device of FIG. 7.
Figure 8B:
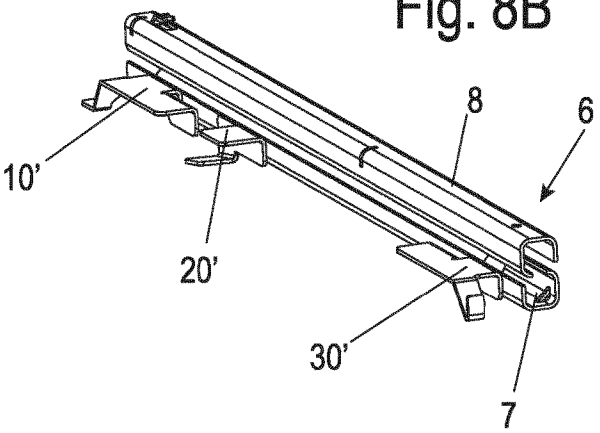
Figure 8A:
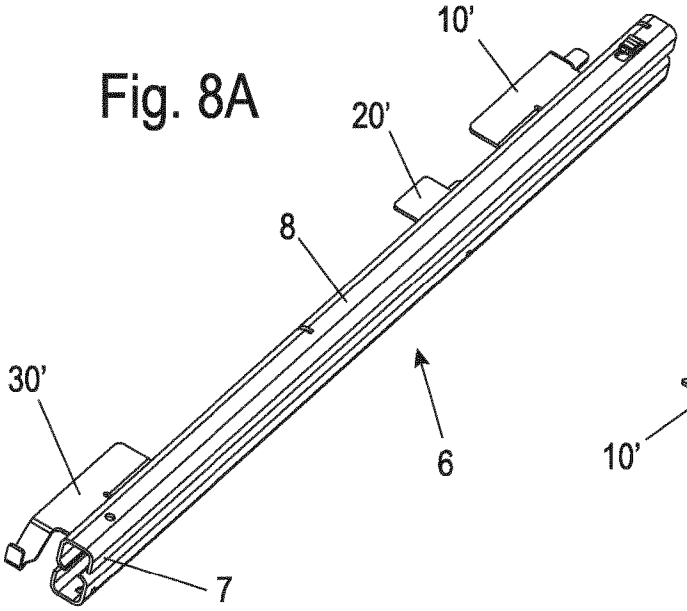
Figure 8D:
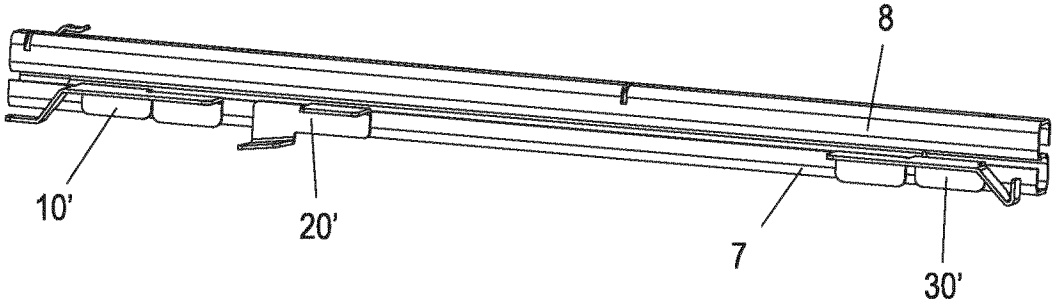
Figure 9A:
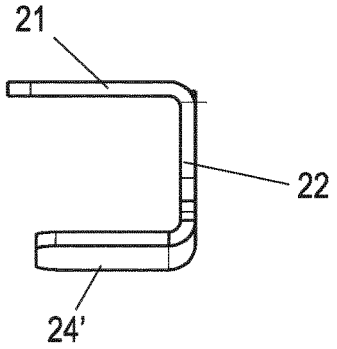
FIGS. 9A to 9D are several views of a holder for the pull-out guide of FIG. 8.
Figure 9B:
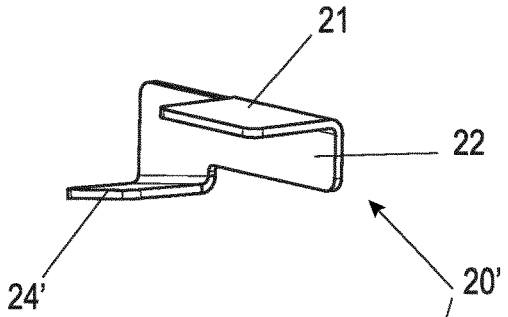
Figure 9C:
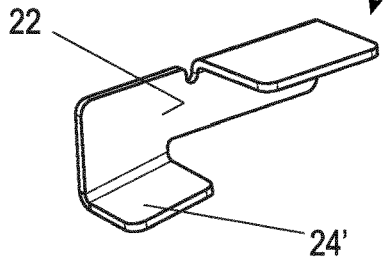
Figure 9D:
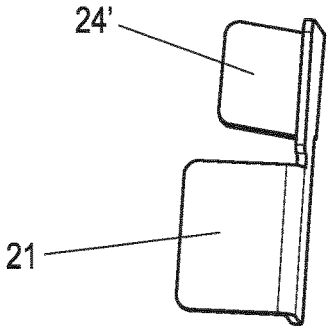
Figure 10A:
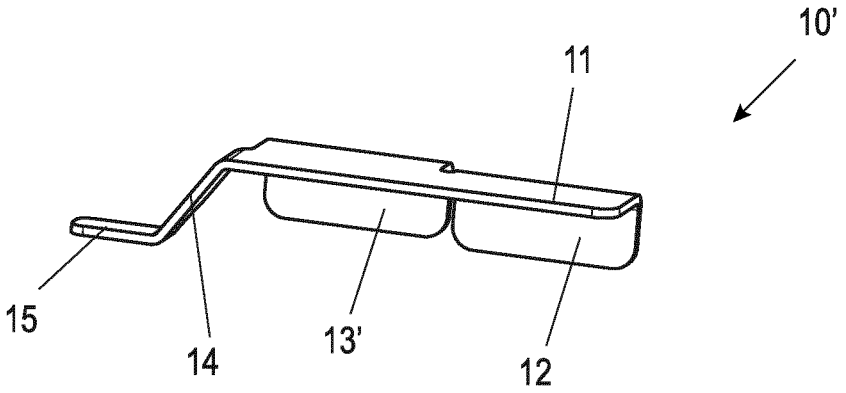
FIGS. 10A to 10D are several views of another holder for the pull-out guide of FIG. 8.
Figure 10B:
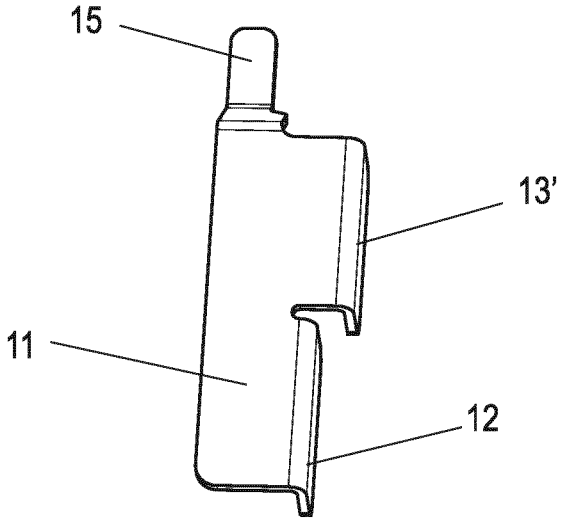
Figure 10C:
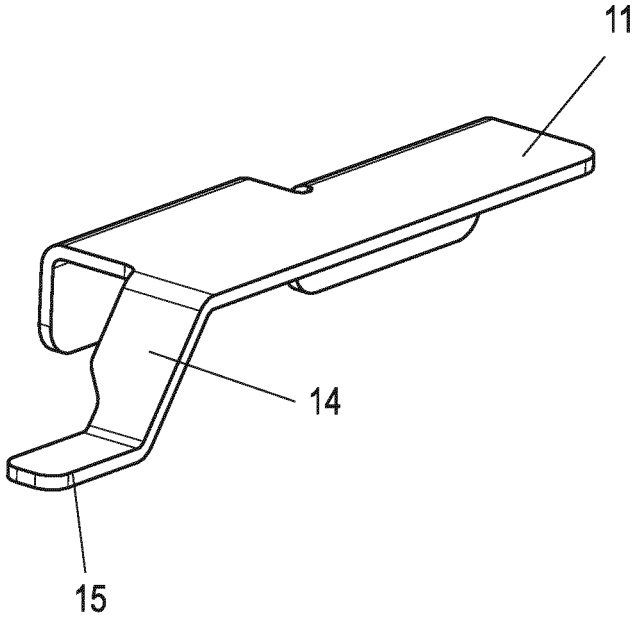
Figure 10D:
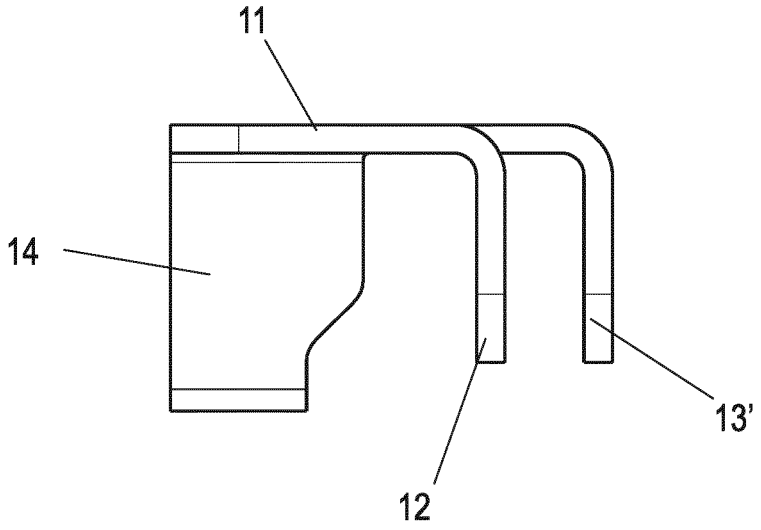

FIG. 7 shows a modified example of a guide device in which a cooking rack 100 is movably held on two pull-out guide 6, as in the previous example, whereby the pull-out guide 6 are each fixed to a side grid.

FIGS. 8A to 8D show pull-out guide 6 with holders 10', 20' and 30', which can be used to fix pull-out guide 6 to one of the side grids 2. The holders 10', 20' and 30' are fixed, preferably welded, to the stationary rail 7 of the pull-out guide 6. The connecting surface of the holders 10', 20' and 30' with the stationary rail 7 is, however, not provided below the strut 3 as in the first design example, but essentially in the area of the strut 3. Therefore, the connecting surfaces are provided offset in horizontal direction to the contact surfaces of the holders 10', 20' with which the holders 10', 20' and 30' rest against the strut 3. This offset arrangement prevents the pull-out guide 6 from resting against strut 3 in the assembled state and prevents grinding the movable rail 8, the cover 9 or the cooking rack 100 along the strut during the extension movement. Seen in vertical direction, the connecting surfaces and the contact surfaces are essentially in one plane.

FIGS. 9A to 9D show the middle holder 20' in detail. The middle holder 20' comprises an upper section 21 which rests horizontally on a top of strut 3. In addition, the holder 20' comprises a vertical web 22 which rests flat against a vertical outer surface of strut 3. From the vertical web 22, a lower web 24' extends in the same direction as the upper section 21, whereby the section 21 and the web 24 are offset from each other in the longitudinal direction so that there is no direct U-shaped wrapping in one plane.

FIGS. 10A to 10D show the holder 10' in detail. The holder 10' comprises an upper horizontal section 11, from which a vertical web 12 for contact with strut 3 and a vertical web 13' for fixing the stationary rail 7 extend, offset in a longitudinal direction. In addition, an inclined section 14 extends from the section 11 to a retaining web 15, which engages under a strut 3 in the area of the angled end section 3*b*.

Figure 11A:
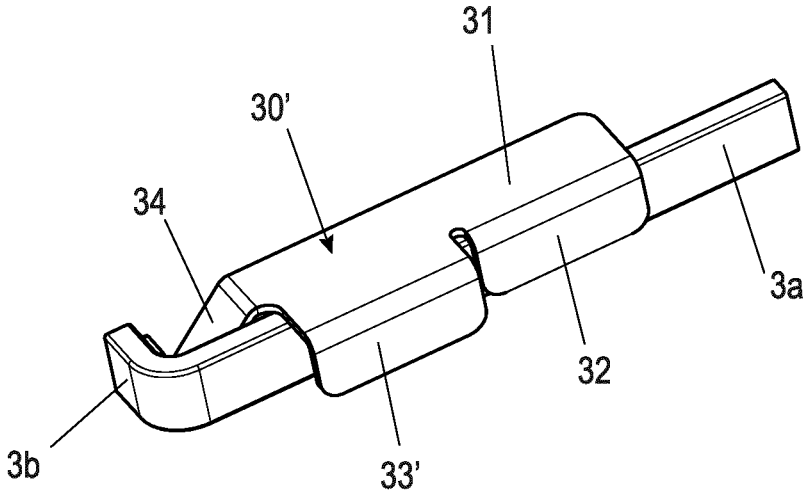
FIGS. 11A to 11D are several views of a holder on a strut for fixing to the pull-out guide in FIG. 8.
Figure 11B:
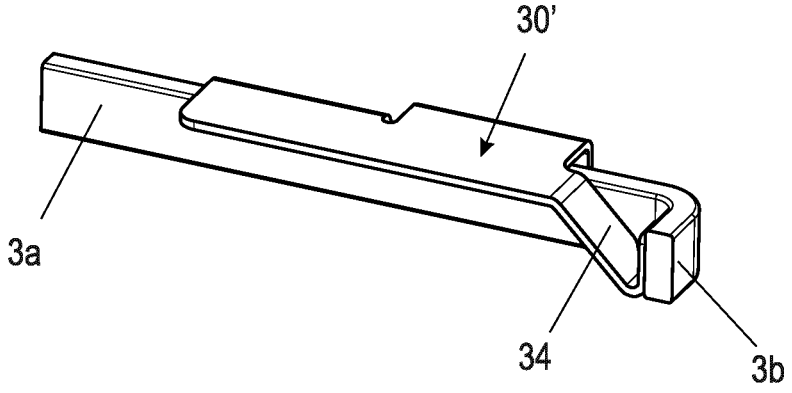
Figure 11C:
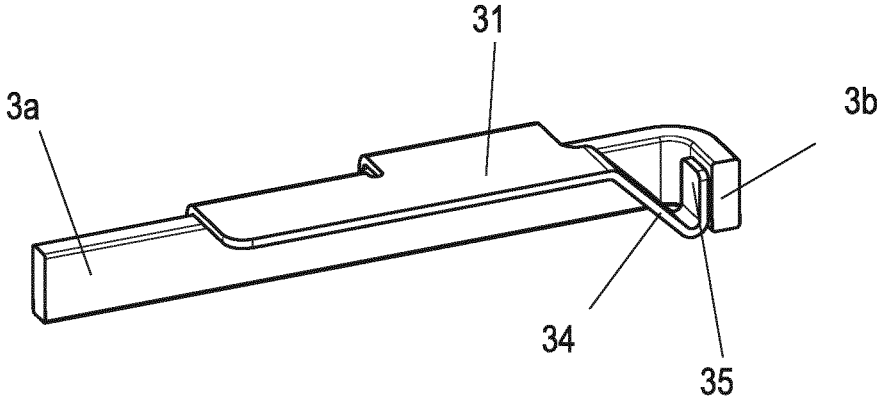
Figure 11D:
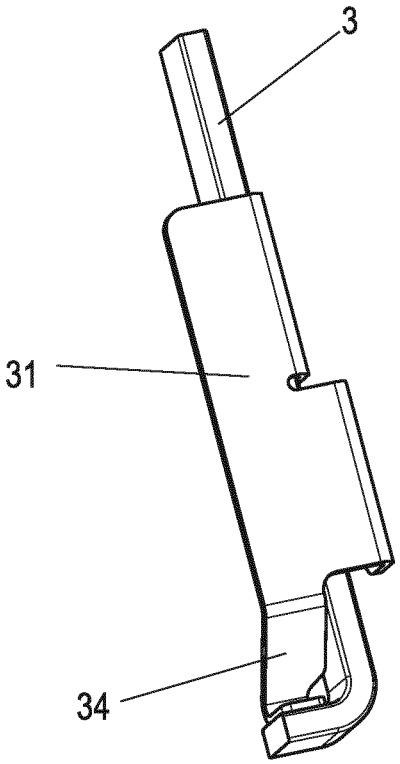

FIGS. 11A to 11D show the holder 30' together with a section of a strut 3. The holder 30' also includes an upper section 31, which is horizontally aligned and from which a first vertical web 32 extends to rest against a section 3*a* of strut 3 and a second web 33' to which the stationary rail 7 is fixed. The vertical webs 32 and 33' are located at approximately the same height, but offset from each other in the longitudinal direction of the pull-out guide 6. The holder 30' also includes an inclined web 34 and a vertical web 35 that rests against the angled end section 3*b* of strut 3, as shown in FIG. 11C.

Figure 12A:
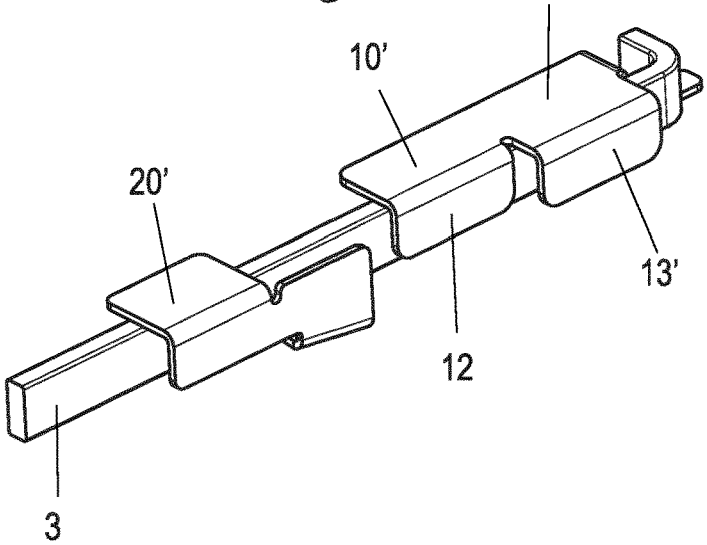
FIGS. 12A to 12C are several views of two holders on a strut for fixing the pull-out guide of FIG. 8.
Figure 12B:
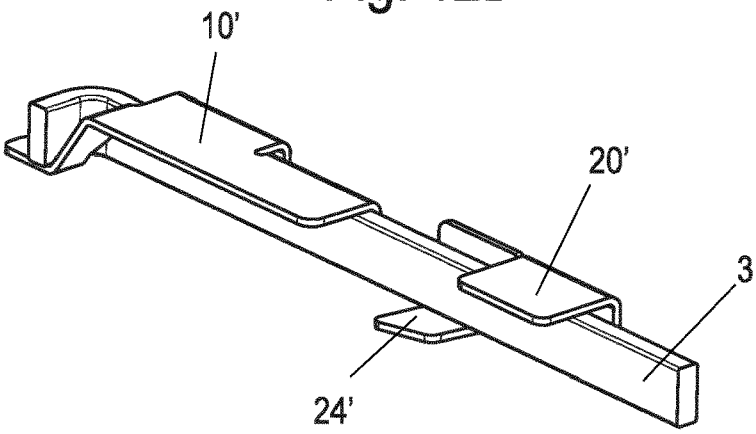
Figure 12C:
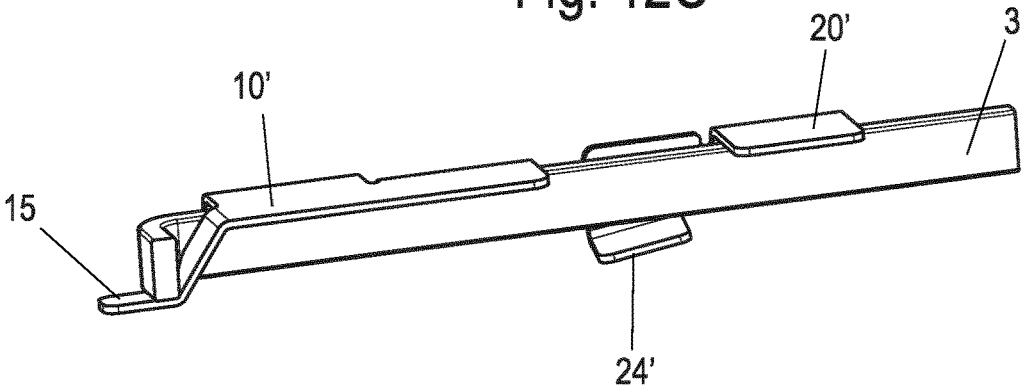

FIGS. 12A to 12C show the two holders 10' and 20' together with strut 3. It can be seen that both the holder 20' with the retaining web 24 and the holder 10' with the web 15 engage under the strut 3. In addition, the holders 10' and 20' with the horizontal sections 21 and 11 overlap the strut 3, whereby the sections are arranged offset to each other in a longitudinal direction so that there is no direct U-shaped embracement in one plane.

Figure 13A:
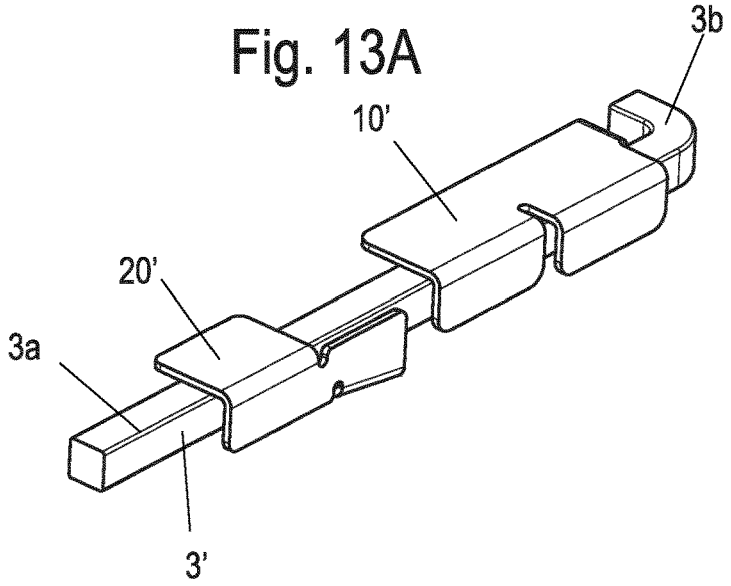
FIGS. 13A to 13C are two views of the holders of FIG. 12 on a modified strut.
Figure 13B:
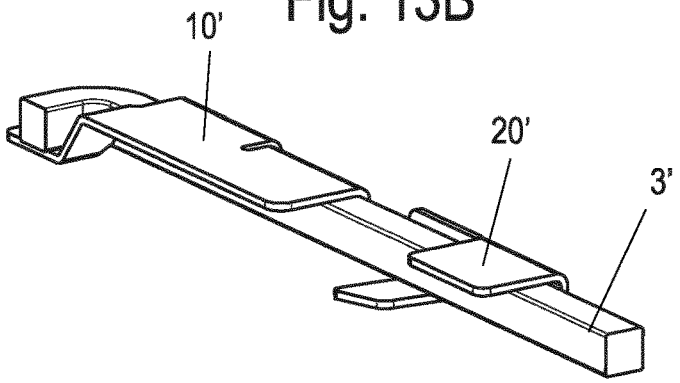
Figure 13C:
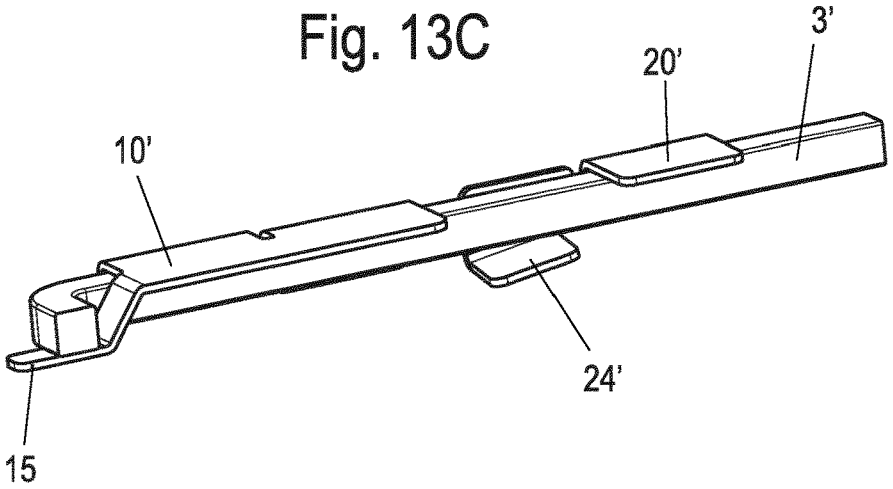

FIGS. 13A to 13C show the holders 10' and 20', which are fixed to a 3' strut. In contrast to the previous example, the cross section of strut 3' is not rectangular, but square. In all other respects, the fixing of the pull-out guide 6 is carried out as in the previous design example. The struts 3 and 3' are designed as full profile, i.e., without hollow chamber.

Figure 14A:
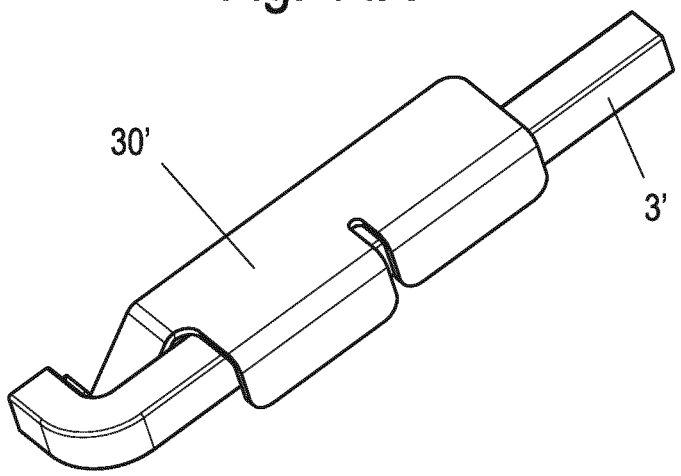
FIGS. 14A to 14C are multiple views of the holder of FIG. 10 on a modified strut.
Figure 14B:
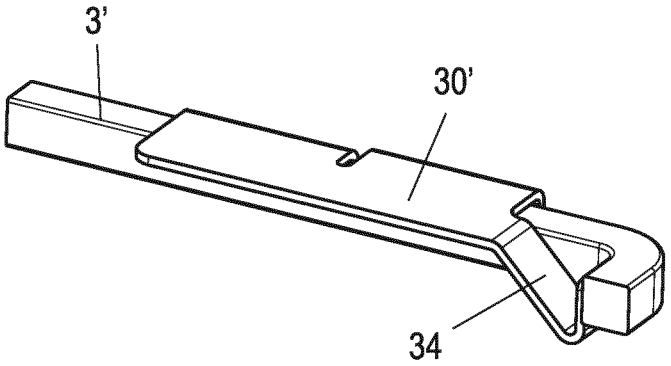
Figure 14C:
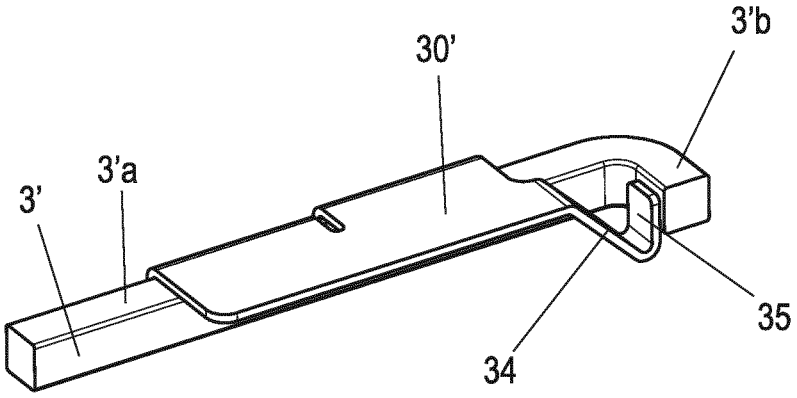

FIGS. 14A to 14C show the strut 3' together with the holder 30', which contacts the strut 3' both in the area of a section 3'*a* in the longitudinal direction and at an angled end section 3*b'*.

Figure 15A:
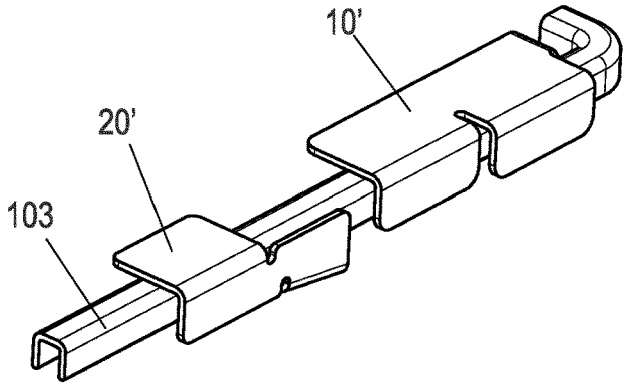
FIGS. 15A to 15C are multiple views of the holders of FIG. 12 on a modified strut.
Figure 15B:
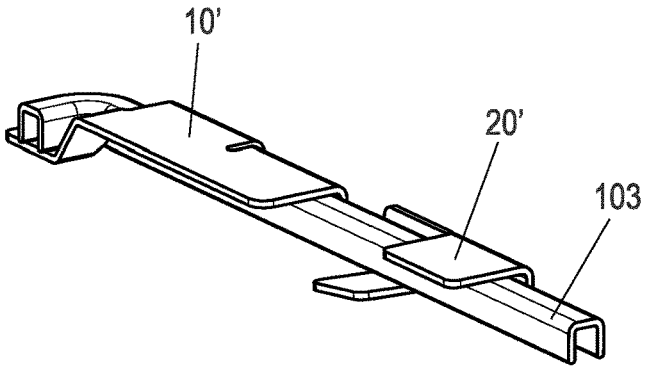
Figure 15C:
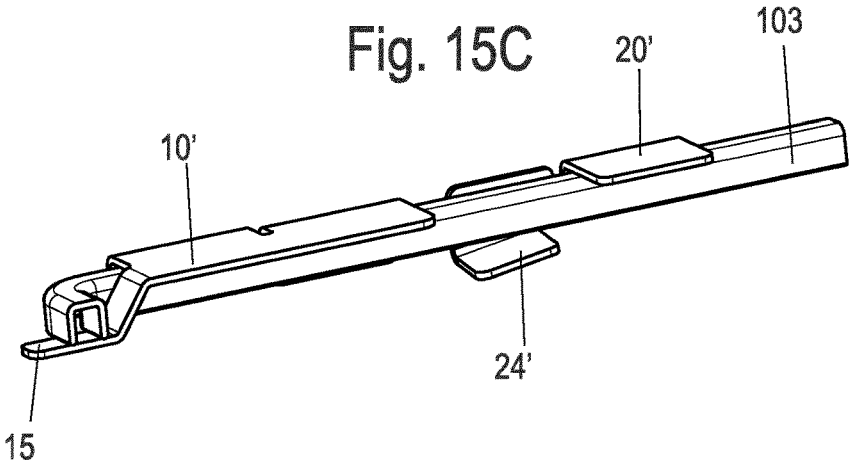

FIGS. 15A to 15C show a modified design of a strut 103 which can be used on a side grid 2. Two holders 10' and 20' are shown on strut 103 as an example to fix a pull-out guide 6. The strut 103 has a U-shaped cross-section and can be made of a bent sheet metal, for example. The two downward protruding legs of strut 103 are arranged parallel and spaced apart.

Figure 16:
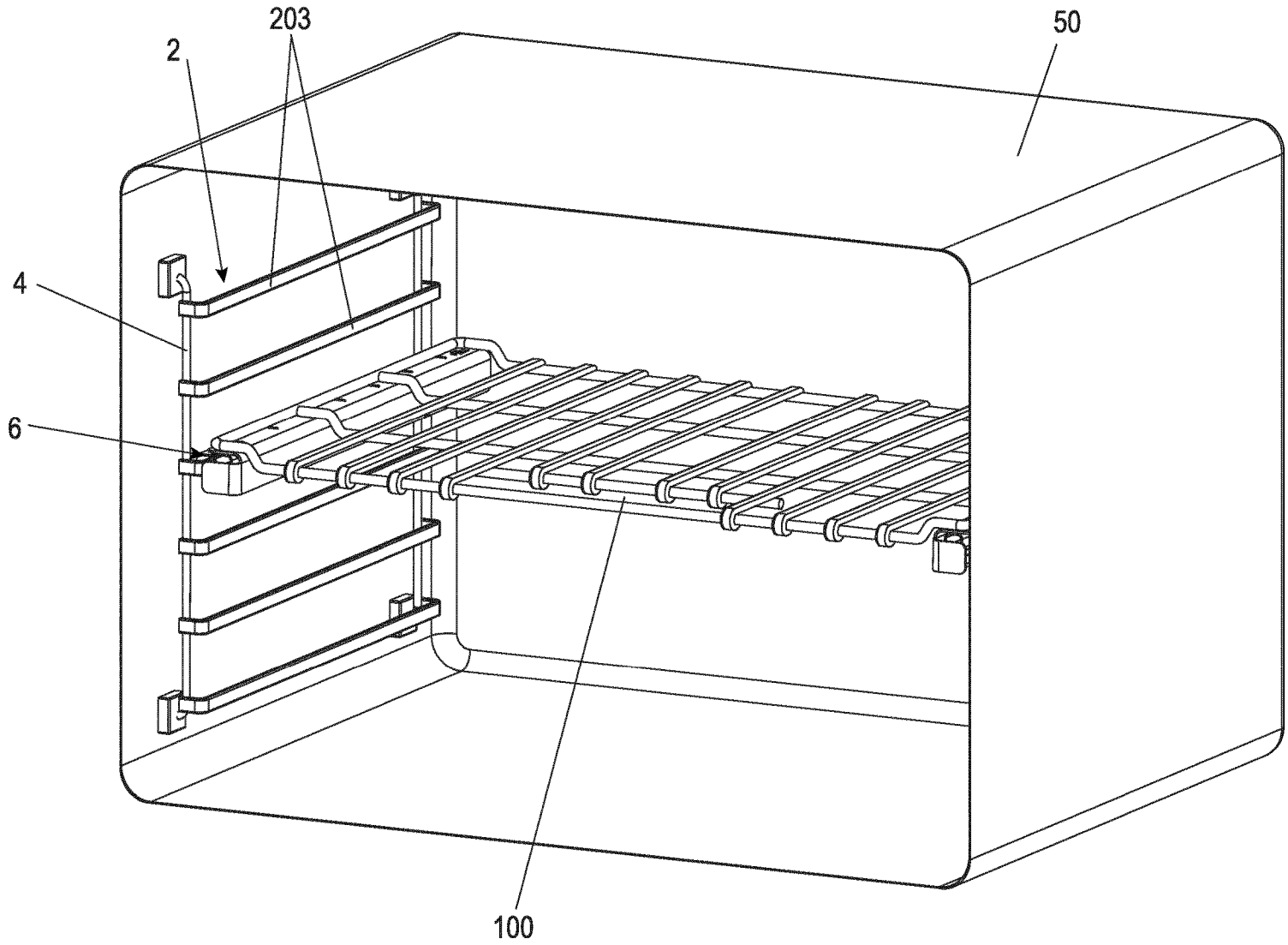
FIG. 16 is a view of an oven muffle with a guide device according to the invention.

FIG. 16 shows a guiding device 1, which is located in an oven muffle 50 of an oven. On opposite sides of the baking oven muffle 50, a side grid 2 is provided with horizontal struts 3, which are not circular in cross section. A pull-out guide 6 is fixed to at least one strut 3 in order to displace a cooking rack 100.

Figure 17A:
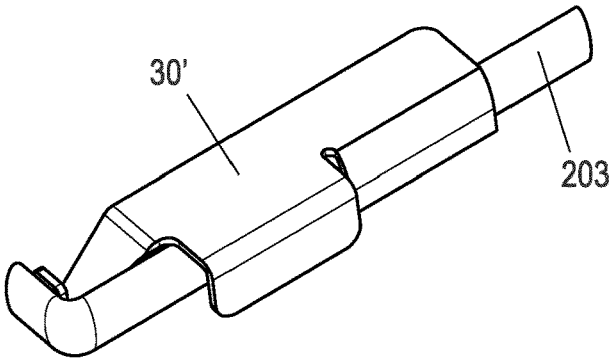
FIGS. 17A to 17C are two detail views of a holder on a modified strut.
Figure 17B:
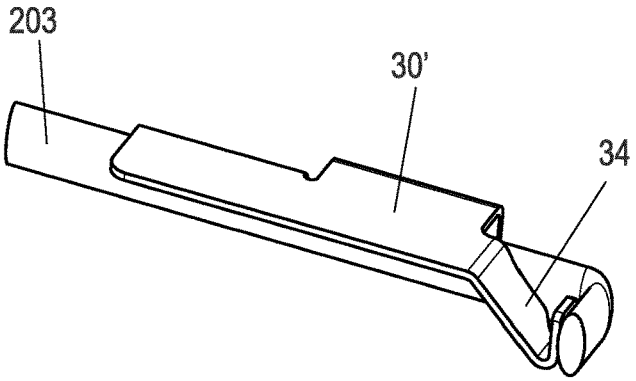
Figure 17C:
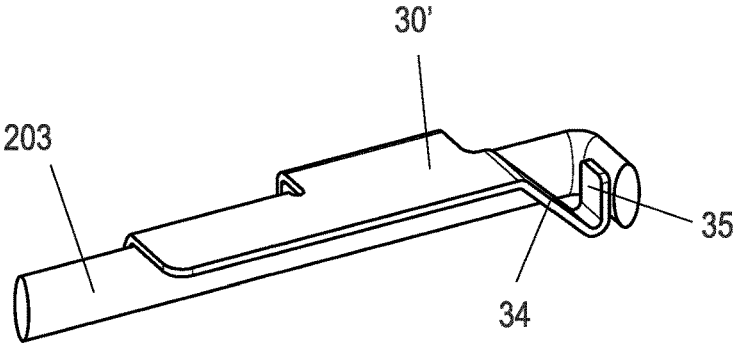

FIGS. 17A to 17C show a holder 30' fixed to a strut 203. The strut 203 is not rectangular in cross-section, but oval. The holders 10, 20, 30 and 10', 20' and 30' can also be fixed to such a strut 203. For this purpose, the holder 30' can have a curved contour in the area of the contact surface that is adapted to the contour of strut 203. For example, the vertical web 35 of the holder 30' can be bent to ensure a flat contact at the angled end section of strut 203. The transition between the horizontal and vertical sections of the holders 10, 20 and 30 can also be bent accordingly.

The cross-sectional shape of the struts 3, 3', 103 and 203 can be varied in order to be able to absorb particularly high load capacities or to ensure a particularly stable fixing of the holders.

In the design example shown, each pull-out guide 6 is fixed to the side grid 2 via three holders 10, 20, 30 or 10', 20', 30'. It is of course also possible to fix each pull-out guide 6 to the side grid 2 using only two holders, in particular a front and a rear holder, or using more than three holders. In addition, several pull-out guides 6 can also be fixed to different struts 3 on one side grid 2.

The holders 10, 20, 30 or 10', 20', 30' are each made of bent sheet metal. They can also be made of plastic, especially a heat-resistant plastic.

The invention claimed is:

1. A guide device for a cooking rack, comprising a side grid and a pull-out guide having a stationary rail and a movable rail, wherein the stationary rail can be fixed to a strut of the side grid via at least two holders, wherein at least the strut on which the at least two holders are fixed has a rectangular cross section, wherein the at least one of the at least two holders comprises an upper horizontal section from which an angled vertical web runs downward, wherein the upper horizontal section of the at least one of the at least two holders has a bearing surface which bears against an external contact surface of the strut on which the at least two holders are fixed, and wherein the angled vertical web of the at least one of the at least two holders has a further bearing surface which bears against a further external contact surface of the strut on which the at least two holders are fixed.

2. The guide device according to claim 1, wherein at least one of the at least two holders has a tab or web which engages under the strut.

3. The guide device according to claim 1, wherein at least one of the at least two holders embraces the strut in a U-shaped manner.

4. The guide device according to claim 1, wherein at least one of the at least two holders has a first vertical connecting surface to which the stationary rail is welded and a second vertical surface which abuts the strut.

5. The guide device according to claim 4, wherein the first vertical connecting surface and the second vertical surface are arranged offset to each other in the horizontal direction.

6. The guide device according to claim 4, wherein the first vertical connecting surface and the second vertical surface are arranged in one plane in the horizontal direction.

7. The guide device according to claim 1, wherein the strut is formed as a solid profile.

8. The guide device according to claim 1, wherein the at least one strut is made of a bent steel sheet.

9. The guide device according to claim 1, wherein the at least two holders fixing the stationary rail to the strut of the side grid comprises three holders are fixed to the stationary rail.

10. The guide device according to claim 1, wherein the vertical extension of the strut corresponds to at least 40% of the vertical extension of the stationary rail.

11. A baking oven with a baking oven muffle in which a guiding device according to claim 1 is provided on opposite sides.

12. The guide device according to claim 1 wherein the rectangular cross-section of the strut has a vertical dimension and a horizontal dimension at least two times the vertical dimension.

* * * * *